US006079177A

United States Patent [19]

Halchuck

[11] Patent Number: 6,079,177

[45] Date of Patent: Jun. 27, 2000

[54] REMOVABLE CEILING PANEL ASSEMBLY

[76] Inventor: Michael A. Halchuck, 303 Carriage La., Canfield, Ohio 44406

[21] Appl. No.: 09/123,904

[22] Filed: Jul. 28, 1998

[51] Int. Cl.[7] ..... E04B 9/04; E04B 9/22

[52] U.S. Cl. ..... 52/506.06; 52/314; 52/483.1; 52/506.1

[58] Field of Search ..... 52/314, 483.1, 52/506.06, 506.08, 506.09, 506.1, 591.4

[56] References Cited

U.S. PATENT DOCUMENTS

| | | | |
|---|---|---|---|
| 143,197 | 9/1873 | Tartiere | 52/506.08 X |
| 2,044,101 | 6/1936 | Reel | 52/506.1 |
| 2,311,590 | 2/1943 | Feder . | |
| 2,440,936 | 5/1948 | Elmendorf et al. | 52/483.1 |
| 3,456,411 | 7/1969 | Cacossa | 52/506.1 |
| 3,495,372 | 2/1970 | Wenger et al. | 52/506.1 X |
| 3,507,083 | 4/1970 | Fish, Jr. et al. | 52/506.08 |
| 3,545,154 | 12/1970 | Bobzin et al. | 52/460 |
| 3,802,142 | 4/1974 | Fehr . | |
| 4,413,457 | 11/1983 | Lahm et al. . | |
| 4,727,700 | 3/1988 | Eberle | 52/483.1 X |
| 4,835,916 | 6/1989 | Steadman | 52/506.06 X |
| 4,841,709 | 6/1989 | Peterson et al. | 52/506.06 X |
| 5,142,836 | 9/1992 | Kearns . | |
| 5,261,204 | 11/1993 | Neff | 52/506.06 |

*Primary Examiner*—Richard Chilcot
*Attorney, Agent, or Firm*—Robert J. Herberger, Esq.

[57] ABSTRACT

A ceiling panel assembly is provided which connects directly to ceiling joists. The assembly has a plurality of ceiling panels and connecting hardware. Each ceiling panel has at least two oppositely disposed edge regions forming recesses. The edge regions of adjacently assembled ceiling panels define grooves with their respective recesses. The connecting hardware is adapted to connect each ceiling panel in the defined grooves directly to the ceiling joist.

14 Claims, 4 Drawing Sheets

REMOVABLE CEILING PANEL ASSEMBLY

FIELD OF THE INVENTION

This invention relates generally to a ceiling panel assembly, and more particularly to a novel and improved ceiling panel assembly having a structure which is removable and not otherwise suspended from ceiling joists as a typical drop ceiling assembly.

BACKGROUND OF THE INVENTION

Various types of ceiling assemblies are known for providing a finished ceiling. For example, a suspension ceiling consists of a grid having rectangular panels placed therein. Generally, such grids are suspended below the ceiling joists by suspension wires. In a typical drop ceiling assembly, the height of the ceiling is dropped between 6 to 8 inches allowing for the removeability of the individual panels.

Other known ceiling assemblies use drywall or tongue and groove panels and/or tiles attaching directly and permanently to the ceiling joists. Such ceiling assemblies, however, do not provide for accessability to utility fixtures, such as plumbing and electrical fixtures, since the panels and/or tiles are permanently secured to the ceiling joists.

Another ceiling panel assembly is illustrated in U.S. Pat. No. 3,802,142. Therein, the ceiling panel assembly has a plurality of panels, each attached to the ceiling joists by screws in combination with track molding. Such an assembly does not allow for the panels to be easily removed one panel at a time, as in this invention, because of the track molding secured around each panel, as well as the panels adjacent thereto.

These known assemblies either require a large amount of space (drop ceilings), or require individual panel enhancement (panel used in combination with track molding). Neither option is optimal where space is limited and/or costs are a factor.

It would therefore, be desirable to have an assembly with neither of the drawbacks noted for the known assemblies.

SUMMARY OF THE INVENTION

This invention provides such a ceiling panel assembly having an attractive appearance and which includes a plurality of separate polygonal shaped panels such as squares or rectangles. A square and/or rectangular appearance is formed by the provision of shallow transverse grooves across the underside of each panel. At least two oppositely disposed edge regions of each panel form a recess which defines a portion of a groove, which are defined when a panel is disposed next to a corresponding vertical edge of an adjacent panel. The full groove width is substantially equal to the width of the individual recesses defined by the abutting panel edges. The groove design can be varied, for example, the design shown in the drawings comprise orthogonal, parallel, rectangular paths in cross sections. Different skewed extensions [paths] and cross-sectional sectional configurations are possible.

The panels are secured directly to the ceiling joists at the panel edge abutments and in the grooves by the use of washers and screws. The washers and screws are preferably somewhat obscured due to their placement in the grooves so that the visual impression is of a pattern of polygonal sub-panels suspended in space. In other words, the ceiling panel assembly of the present invention provides for the appearance of a suspended ceiling without sacrificing the ceiling height associated with suspended ceilings since each ceiling panel of this invention is attached directly to the ceiling joist at at least two oppositely disposed edge regions, and without track molding except, possibly at the wall. Also, the present invention provides easy accessibility to the utility fixtures above the ceiling. To get accessibility, the appropriate panel is removed simply by removing the securing screws and washers to drop the corresponding panel. The panel is then easily re-secured when desired. Since each ceiling panel in this invention is larger than the sub-panel pattern, upon removing each panel, more work area is provided than is available with the typical suspended ceiling. With the typical suspended ceiling, the grid system remains in place when panels are removed, thereby limiting the work area.

To support the outer edge along the wall for the ceiling panel in this invention, wall angle or cove molding may be used. The wall angle or cove molding serves to lend structural support directly to those panels along the walls.

These and other aspects of the present invention are more fully discussed in the following specification taken in conjunction with the drawings.

BRIEF DESCRIPTION OF THE DRAWINGS

Seven figures (1–4A, 4B–6) have been selected to illustrate preferred embodiments of the present invention. These figures and the associated description is considered sufficient for those skilled in the art to understand and practice the invention.

DETAILED DESCRIPTION OF THE PREFERRED EMBODIMENTS

Figure 1:
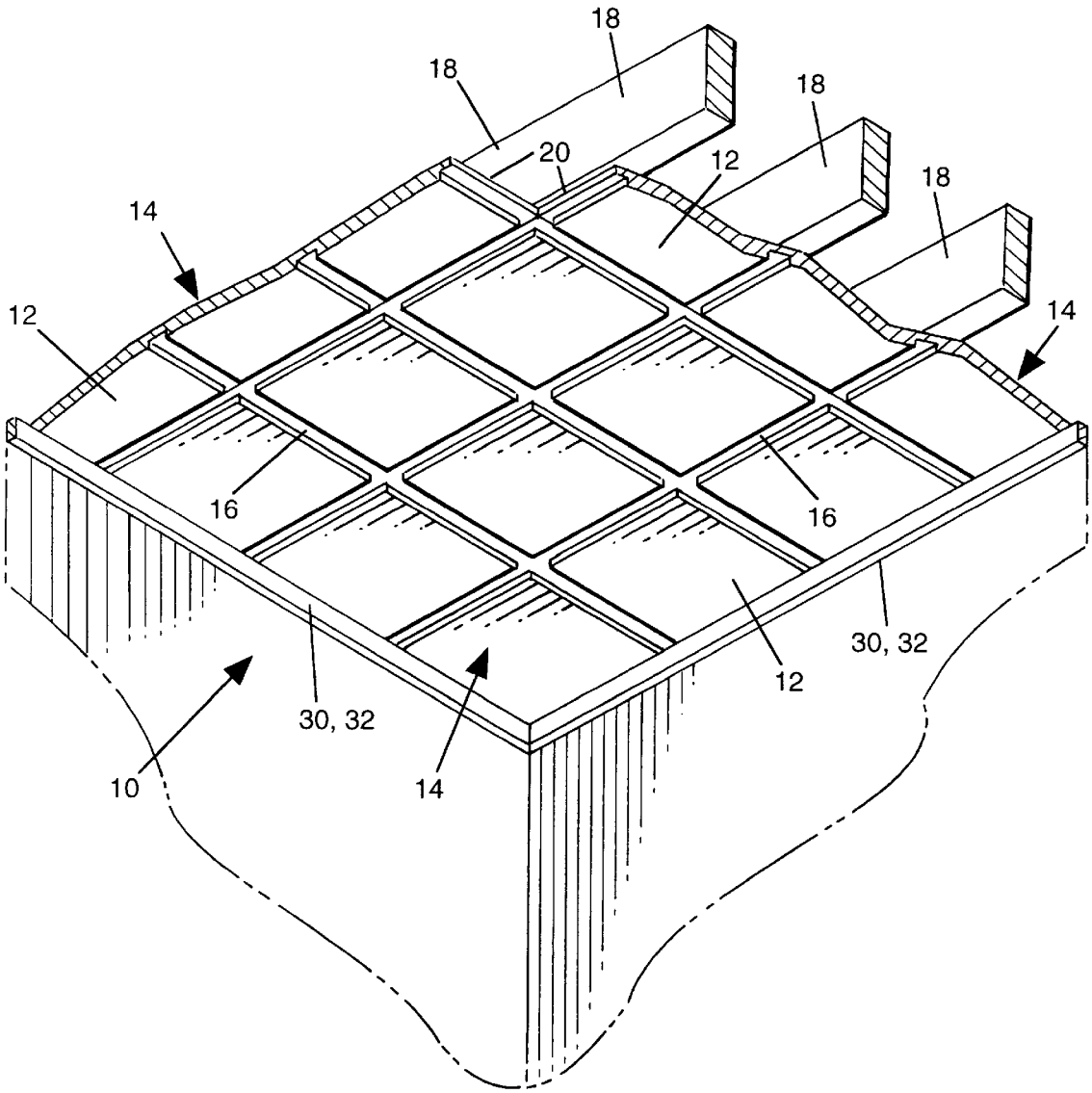
FIG. 1 is a fragmentary, perspective view of a ceiling panel assembly showing generally the details of the present invention.

Referring to FIG. 1, a preferred embodiment of this invention provides a ceiling panel assembly 10 consisting of a plurality of panels 14. The panels 14 may be 16" by 48", 32" by 48" or 48" by 48" with the square 48" by 48" being preferred. Panels 14 are constructed by vacuum forming or other method using celotex, polystyrene or fiberglass type material or wood fiber composite board and being preferably Class A fire-retardant and resilient to water absorption [i.e., humidity]. Each of the panels 14 are formed so as to have on one face thereof a plurality of sub-panels 12 having substantially identical regular polygonal shapes such as squares shown in FIG. 1. Preferably each of the sub-panels 12 is positioned immediately adjacent to a neighboring shape with shallow transverse grooves 16 therebetween giving the illusion that the panel is formed by small panels of 16"×16"

in size fitted together which is typically the width between ceiling joists 18.

Figure 2:
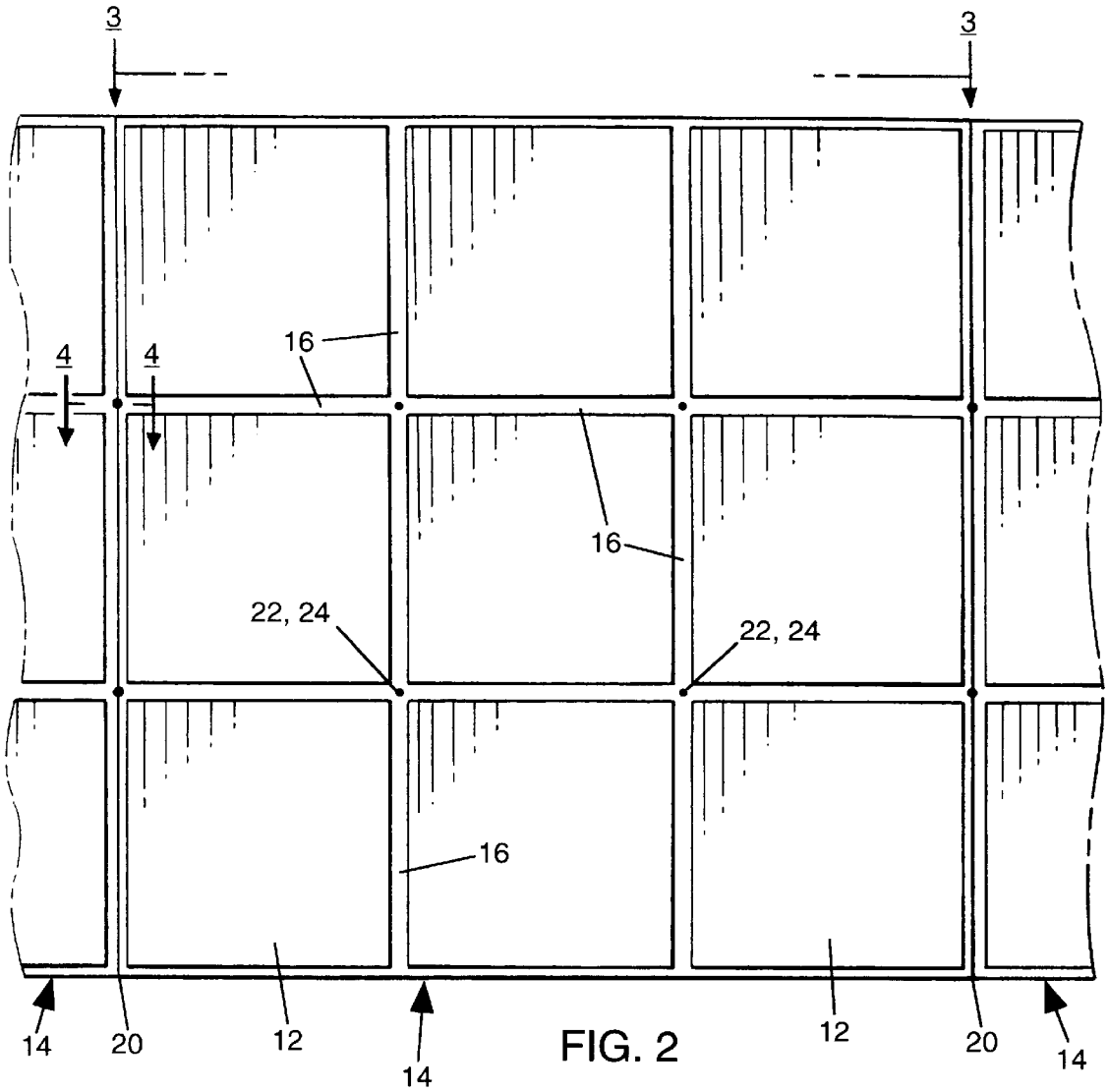
FIG. 2 is a bottom plan view of a ceiling panel assembly in accordance with the present invention.
Figure 3:
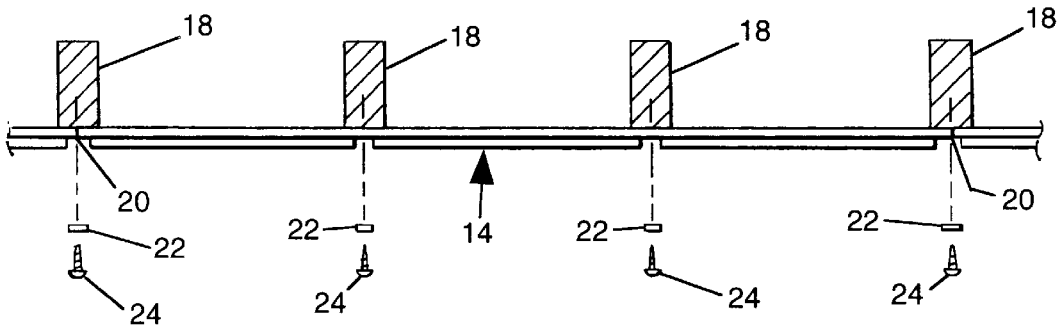
FIG. 3 is an enlarged sectional view of FIG. 1, taken along line 3—3 of FIG. 2 showing a cross section of a ceiling panel assembly.
Figure 4A:
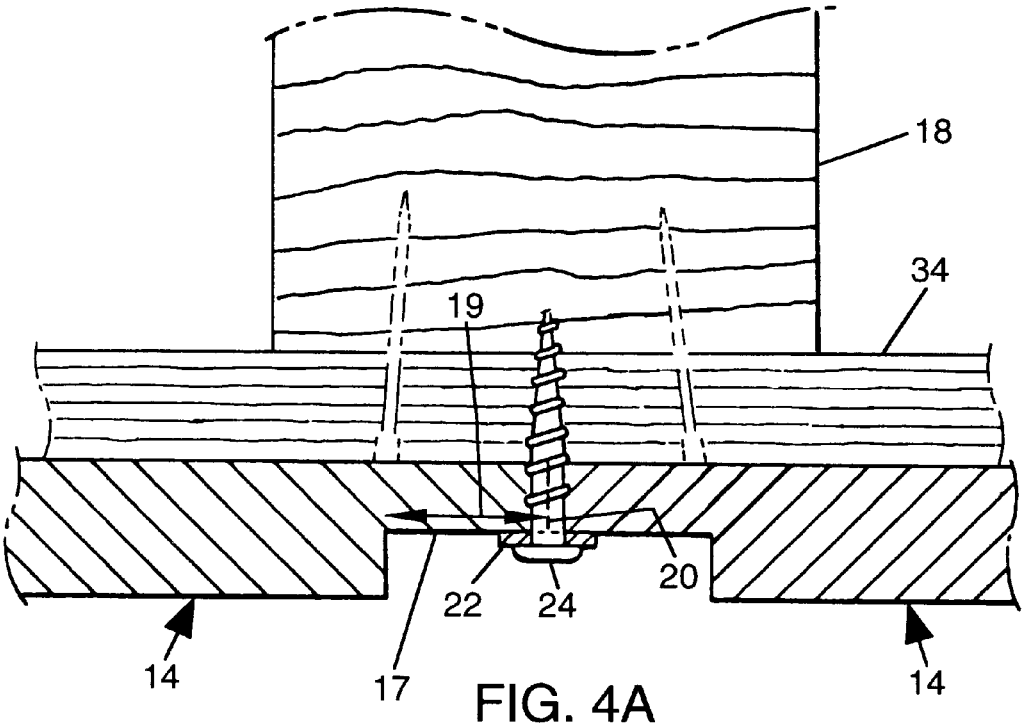
FIG. 4A is an enlarged fragmentary sectional view showing adjacent abutting panels attached to a ceiling joist via a furring strip.

The grooves 16 are preferably aligned with the ceiling joists 18 as shown in FIGS. 1 and 3. Referring to FIG. 2, the center area of the panel 14 is supported by washers 22 positioned underneath the panel at the junctions 20 where the grooves cross, and the panels 14 are secured therethrough to the joists 18 by screws 24. The width of the washers can be varied and should be sufficient to support the panel weight. Adjacent panels align flush in side-by-side, or coplanar relation and are secured to the ceiling joist 18 using washers 22 and screws 24 so that the washers overlap the adjacent panels providing support for both corresponding panels as shown in FIG. 4A. Furring strips 34 may be used between the panel 14 and ceiling joist 18 if the joists are uneven in height. The grooves 16 between adjacent panels 14 are defined by recesses 17 formed by edge regions 19 of each ceiling panel 14 as shown in FIG. 4A. The full groove width between adjacent panels 14 is substantially equal to the total width of recesses 17 defined by abutting panel edges.

Figure 4B:
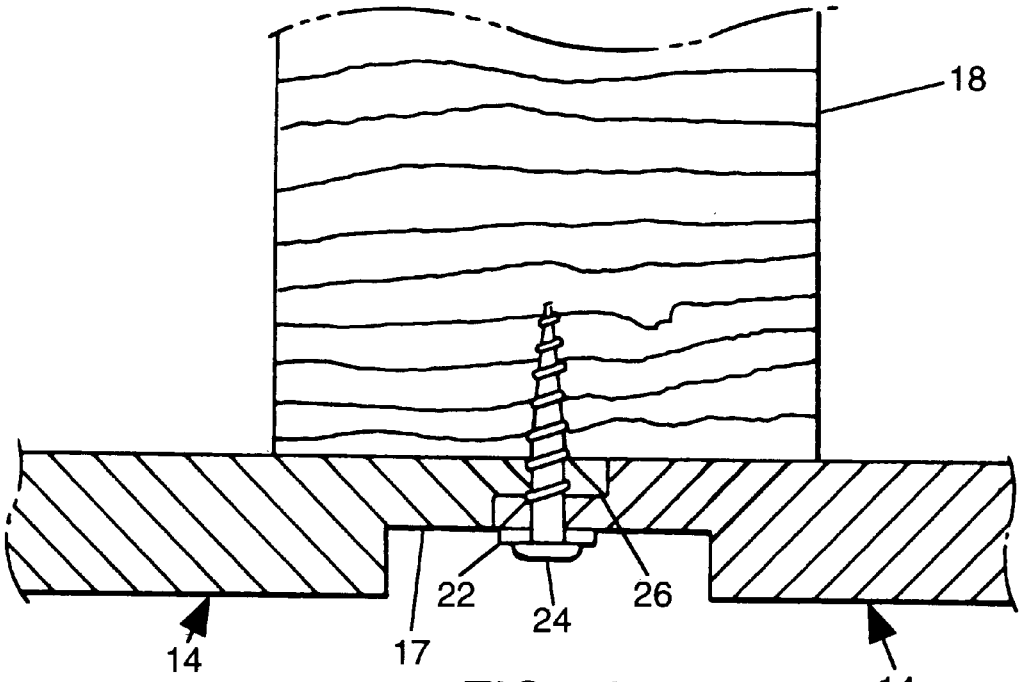
FIG. 4B is an alternative embodiment of FIG. 4A showing a ship-lap interface between adjacent panels attached to a ceiling joist.

As an alternate design shown in FIG. 4B, the sides of adjacent panels are aligned and overlap using a ship-lap interface 26. The ship-lap interface 26 allows the securing screw to pass through both panels, providing a stronger joint therebetween. For each panel 14 using a ship-lap interface 26, two adjacent sides thereof have either the overlap or undercut portion of the ship-lap structure and the other two adjacent sides of the panel 14 have the opposite configuration of the ship-lap structure.

Figure 5:
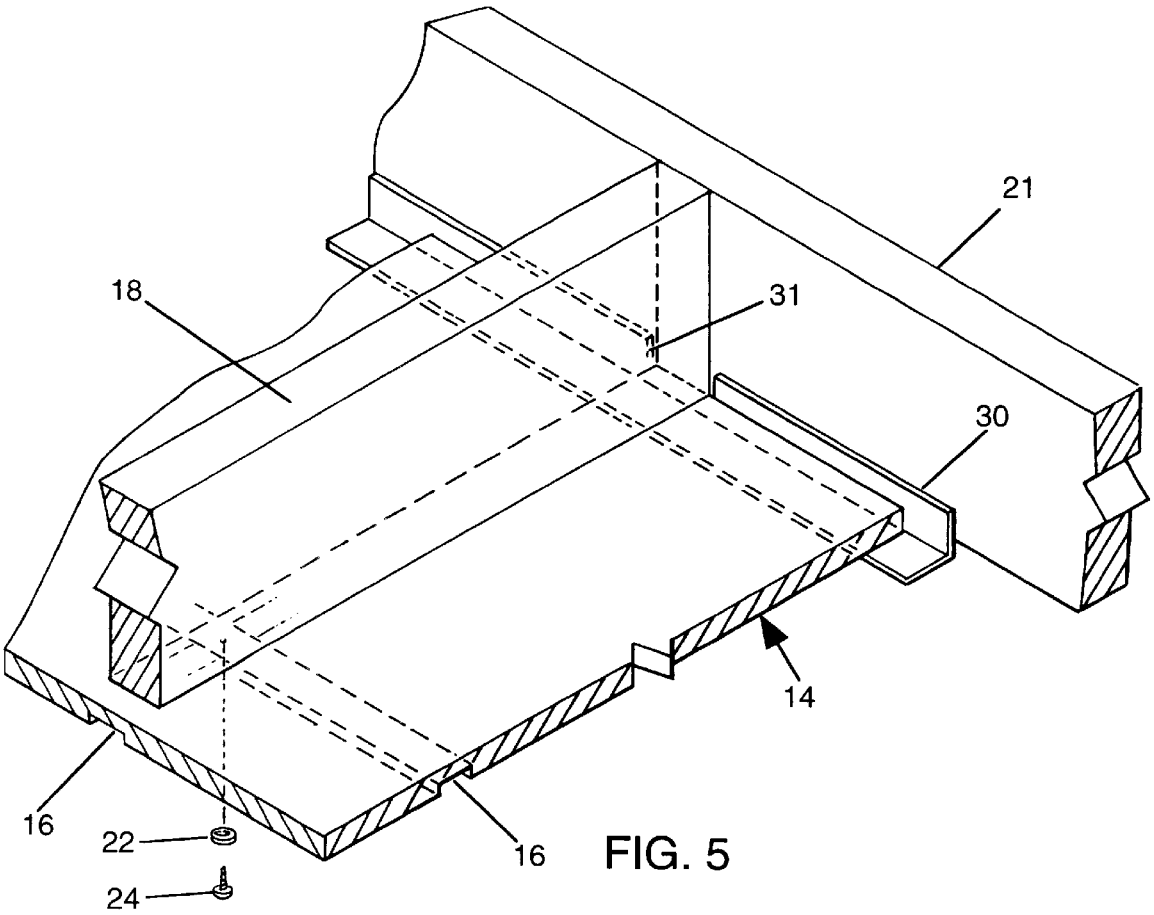
FIG. 5 is a perspective view of a portion of a ceiling assembly mounted along a wall using a wall angle.
Figure 6:
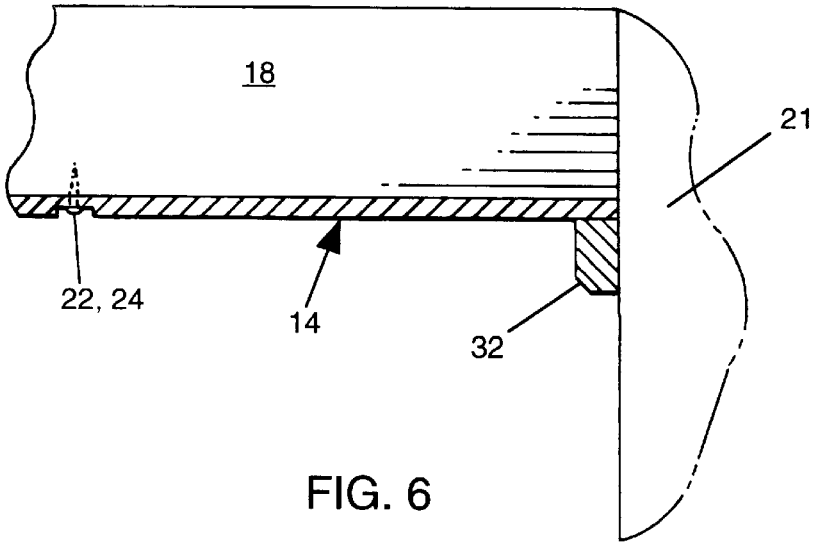
FIG. 6 is a side elevation view of a portion of a ceiling assembly illustrating a cross section of a ceiling panel mounted along a wall using cove molding.

The outer edge region of the ceiling panel assembly 10 along the wall 21 is secured using a wall angle 30 as shown in FIG. 5 or cove mold 32 as showing in FIG. 6. If wall angle is used, the lip of the wall angle extending perpendicular from the wall is suspended below the joist a distance substantially equal to the thickness of the panel 14 so that the panel 14 appears level. For example, if a standard ¾ inch wall angle is used, notches 31 are cut out to accommodate joists 18, as best seen in FIG. 5, and the perpendicular lip of the wall angle is raised assuming the panel thickness is less than ¾ inch.

Thus there is provided a novel ceiling panel assembly 10 which is easy to install allowing accessability above each panel 14 and providing the maximum height of a decorative ceiling. While various changes may be made in the detail of the ceiling assembly 10, it is understood that such changes will be within the spirit and scope of the present invention as is defined by the appended claims.

I claim:

1. A ceiling panel assembly connected directly to ceiling joists, comprising:

a plurality of non-metallic ceiling panels being independently removable at an isolated location, each ceiling panel having a width being substantially 16, 32 or 48 inches, a center area and at least two oppositely disposed flanged edge regions along the length of the panel, the center area of each panel having a groove traversing and being perpendicular to the oppositely disposed edge regions, the flanged edge regions being integral with said ceiling panels, forming recesses with adjacently assembled ceiling panels and defining longitudinal grooves with their respective recesses and each longitudinal groove generally aligning with one of the ceiling joists; and accessible connecting means removably connecting said plurality of ceiling panels directly to the ceiling joists, said removable connecting means comprising a plurality of washer and screw combinations supporting said plurality of ceiling panels directly to the ceiling joists along said longitudinal and center area grooves, each washer of said washer and screw combination in the longitudinal grooves having sufficient width to lend support to the adjacently assembled ceiling panels, whereby removal of said accessible connecting means does not cause damage to said ceiling panels.

2. The ceiling panel assembly as set forth in claim 1, wherein in the assembly each longitudinal groove is formed by flanged edge regions which are coplanar.

3. The ceiling panel assembly as set forth in claim 1, wherein in the assembly each longitudinal groove is formed by flanged edge regions which overlap without interconnecting or adhering thereto.

4. The ceiling panel assembly as set forth in claim 1, further comprising a wall angle member, wherein a flanged edge region of each ceiling panel adjacent to said wall angle member engages said wall angle member for support.

5. The ceiling panel assembly as set forth in claim 1, further comprising a cove molding member, wherein a flanged edge region of each ceiling panel adjacent to said cove molding member engages said cove molding member for support.

6. A ceiling panel assembly connected directly to ceiling joists, comprising:

a plurality of non-metallic ceiling panels being independently removable at a remote location, each ceiling panel having two sets of oppositely disposed flanged edge regions being integral with said ceiling panel, forming recesses with adjacent assembled ceiling panels and defining outer perimeter grooves with their respective recesses, each ceiling panel having a width being substantially 16, 32 or 48 inches long and having transverse grooves on an underside thereof so as to give the appearance that said panel is comprised of smaller panels;

a plurality of washer and screw combinations supporting the panel to a respective ceiling joist, each said washer and screw combination being accessible and positioned below a junction of said panel grooves and secured therethrough directly to a corresponding ceiling joist such that removal of each said washer and combination does not cause damage to said ceiling panels; and a wall brace member for supporting said ceiling panel assembly along a wall.

7. The ceiling panel assembly as set forth in claim 6, wherein the wall brace member comprises cove molding.

8. The ceiling panel assembly as set forth in claim 6, wherein the wall brace member comprises a wall angle.

9. The ceiling panel assembly as set forth in claim 6, wherein the flanged edge regions of adjacent ceiling panels overlap without adhering to each other or interconnecting forming a ship-lap structure.

10. The ceiling panel assembly as set forth in claim 6, wherein the flanged edge regions of adjacent ceiling panels are substantially flush.

11. A ceiling panel assembly connected directly to ceiling joists, comprising:

a plurality of non-metallic ceiling panels being independently removable at a select location, each ceiling panel having two sets of oppositely disposed flanged edge regions forming recesses with adjacent assembled ceiling panels defining outer perimeter grooves with their respective recesses, each flanged edge region being integrally formed with each ceiling panel, each panel having a width being substantially 16, 32 or 48 inches so that the outer perimeter grooves generally align with the ceiling joists, the ceiling panels each having transverse grooves on an underside thereof so as to give the panel the appearance that said panel is comprised of smaller panels;

a plurality of washer and screw combinations, said plurality of washer and screw combinations being accessible and supporting said ceiling panels directly to the ceiling joists along said transverse and outer perimeter grooves, each washer of said washer and screw combination having sufficient width to lend support to the adjacently assembled ceiling panels such that removal of said washer and screw combinations does not result in damage to said ceiling panels; and a wall brace member, wherein an edge region of each ceiling panel adjacent to said wall brace member engages said wall brace member for support.

12. The ceiling panel assembly as set forth in claim 11, wherein the flanged edge regions of adjacent assembled ceiling panels overlap without interconnecting or adhering thereto, forming a ship-lap structure.

13. The ceiling panel assembly as set forth in claim 11, wherein the wall brace member comprises a wall angle.

14. The ceiling panel assembly as set forth in claim 11, wherein the wall brace member comprises cove molding.

* * * * *